United States Patent [19]

Ohira et al.

[11] Patent Number: 4,901,111

[45] Date of Patent: Feb. 13, 1990

[54] ELECTROPHOTOGRAPHIC COPYING APPARATUS WITH AN EDITING MODE

[75] Inventors: Tadashi Ohira; Masazumi Ito; Syuzi Maruta, all of Osaka, Japan

[73] Assignee: Minolta Camera Kabushiki Kaisha, Osaka, Japan

[21] Appl. No.: 142,799

[22] Filed: Jan. 7, 1988

[30] Foreign Application Priority Data

| | | | |
|---|---|---|---|
| Jan. 9, 1987 | [JP] | Japan | 62-3871 |
| Jan. 9, 1987 | [JP] | Japan | 62-3872 |
| Jan. 16, 1987 | [JP] | Japan | 62-8583 |
| Jan. 28, 1987 | [JP] | Japan | 62-18872 |

[51] Int. Cl.[4] ..... G03G 21/00

[52] U.S. Cl. ..... 355/218

[58] Field of Search ..... 355/3 R, 7, 204, 218

[56] References Cited

U.S. PATENT DOCUMENTS

| | | | |
|---|---|---|---|
| 4,582,417 | 4/1986 | Yagasaki et al. | 355/7 |
| 4,627,707 | 12/1986 | Tani et al. | 355/14 R |
| 4,653,899 | 3/1987 | Watanabe | 355/14 R |
| 4,666,288 | 5/1987 | Watanabe | 355/7 X |
| 4,674,861 | 6/1987 | Kawamura | 355/4 |
| 4,687,317 | 8/1987 | Appel et al. | 355/7 X |
| 4,724,464 | 2/1988 | Umeda et al. | 355/7 X |

*Primary Examiner*—Fred L. Braun

*Attorney, Agent, or Firm*—Price, Gess & Ubell

[57] ABSTRACT

A photocopying apparatus has the capacity to edit desired portions of a document image onto copying paper. A memory is provided for storing area data specifying a specific area of the document. Coordinates of the specific area can be reset in an initial value memory upon the operator selection of an edition mode to facilitate easy selection of a desired portion of the document image.

23 Claims, 13 Drawing Sheets

ELECTROPHOTOGRAPHIC COPYING APPARATUS WITH AN EDITING MODE

BACKGROUND OF THE INVENTION

The present invention relates to a copying apparatus having two modes, i.e., a usual mode wherein the entire image of a document is copied on copy paper, and an edition mode wherein only a desired portion of the document image is copied on copy paper, the apparatus thus being adapted for the edition of documents.

When the portion of a document image to be copied or erased is to be set as an edition area in conventional copying apparatus having an edition mode, data items as to the coordinates of the previously used edition area are generally displayed as initial values for the edition area coordinates when the main switch is turned on or the copying apparatus is reset for starting a copying operation.

Generally, the current edition area differs greatly from the previous edition area, so that setting the edition area often takes time. Moreover, since the initial values of edition area coordinates displayed are different every time, it is difficult to become skillful in setting edition areas.

U.S. Pat. No. 4,582,417 discloses a copying apparatus having an edition mode. With this apparatus, the data regarding the edition area coordinates which are to be set is entered using number entry keys.

For entering data by number entry keys, many keys must be depressed, while a plurality of keys must be manipulated for inputting the position data as to one side. The procedure is cumbersome and inefficient. Moreover, when it is desired to slightly alter the coordinate setting once determined, the cumbersome procedure needs to be repeated again, hence inconvenient.

SUMMARY OF THE INVENTION

A first object of the invention is to provide a copying apparatus wherein when an edition mode is selected, for example, when the main switch is turned on for starting a copying operation, specific area data is designated as the initial edition area coordinate values, and the desired edition area is settable to a variety of positions.

A second object of the invention is to provide a copying apparatus wherein reasonable data is settable as initial edition area coordinate values so that the desired edition area can be set smoothly and quickly.

A third object of the invention is to provide a copying apparatus wherein desired values are settable as initial edition area coordinate values so that the desired edition area can be set smoothly and quickly.

A fourth object of the invention is to provide a copying apparatus wherein the desired edition area is settable smoothly and quickly using up and down keys instead of using number entry keys.

A fifth object of the invention is to provide a copying apparatus wherein when data as to a first coordinate is set, data as to the remaining second coordinate in the same direction as the first coordinate can be set based on the previously set data as its initial value (reference value), whereby the desired edition area can be set smoothly and quickly, permitting the operator to easily recognize the width of the edition area in the coordinate direction.

Other objects and features of the present invention will become apparent from the following description with reference to the accompanying drawings.

DETAILED DESCRIPTION OF THE INVENTION

Embodiments of the invention will be described below with reference to the drawings.

Figure 1:
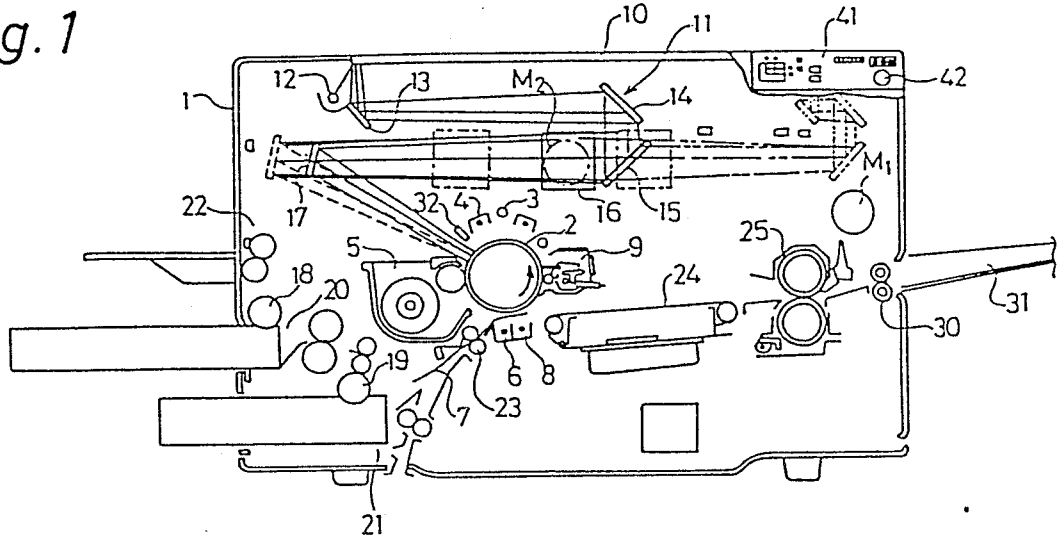
FIG. 1 is a side elevation in vertical section showing an electrophotographic copying machine embodying the invention.

FIG. 1 shows an electrophotographic copying machine having a usual mode wherein a document image is copied in its entirety on copy paper, and an edition mode wherein the desired portion of the document image is copied on copy paper. As seen in FIG. 1, the main body 1 of the copying machine has a photosensitive drum 2 disposed approximately at the center of its interior and drivingly rotatable counterclockwise. Arranged counterclockwise around the drum 2 are a main eraser lamp 3, main charger 4, developing unit 5, transfer charger 6, charger 8 for separating a copy sheet 7 off, cleaner 9, etc.

The drum 2 has over its surface a photosensitive layer which is charged when moving past the main eraser lamp 3 and the main charger 4 and is exposed to a document image by an exposure optical system 11 disposed under a document support glass table 10 at the top of the main body 1. The exposure optical system 11 comprises a light source 12, movable mirrors 13, 14, 15, projection lens 6 and mirror 17. While the drum 2 rotates at a peripheral velocity V (which is definite irrespective of the magnification), a d.c. motor Ml drives the light source 12 and the movable mirror 13 leftward at a velocity of V/n (wherein n is the magnification) and the movable mirrors 4, 15 leftward at a velocity of V/2n, whereby the image of the document on the glass table 10 is scanned to expose the drum 2 to light in the form of a slit. The magnification is altered by shifting the projection lens 16 along its optical axis by stepping motor M2 and shifting and pivotally moving the mirror 17.

The main body 1 is provided at one end lower portion thereof with paper feeders 20, 21 having feed rollers 18, 19, respectively, for feeding the copy sheet 7 to a transfer station between the drum 2 and the transfer and separating chargers 6, 8. A manual insertion paper feeder 22 is also provided above the feeders 20, 21. Disposed immediately in front of the transfer station is a pair of timing rollers 23 for feeding the copy sheet 7 with specified timing, while disposed to the rear of the transfer station are a conveyor belt 24 for transporting the copy sheet 7 bearing a toner image transferred thereto from the drum 2 and separated from the drum, a fixing unit 25 for fixing the transferred image to the sheet 7, and a pair of discharge rollers 30 for delivering the fixed sheet 7 onto a paper tray 31 outside the main body 1.

An eraser unit 32 is provided beside the drum 2 between the exposure station and the main charger 4. The eraser unit 32, when operated, removes the charge given to the drum 2 by the charger 4 so that no electrostatic latent image will be formed and developed on the charge removed area of the drum. Thus, the unit 32 is usually used for preventing image formation between the images to be formed on the drum 2.

Figure 2:
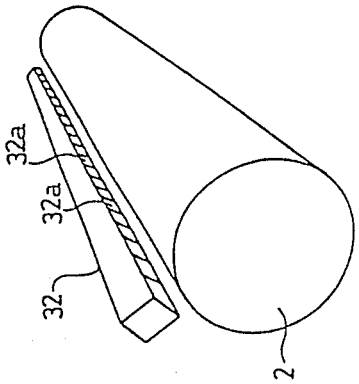
FIG. 2 is a perspective view schematically showing image forming means.

As shown in FIG. 2, the eraser unit 32 comprises a multiplicity of light-emitting diodes 32*a* arranged axially of the drum 2. By controlling the operation of the selected ones of the light-emitting diodes and the operation timing thereof, image formation can be prevented at a desired portion of the usual image forming area on the drum 2 where electrostatic images are formed and developed.

Thus, image forming means is provided by which document images can be copied in the usual mode and the edition mode.

Figure 3:
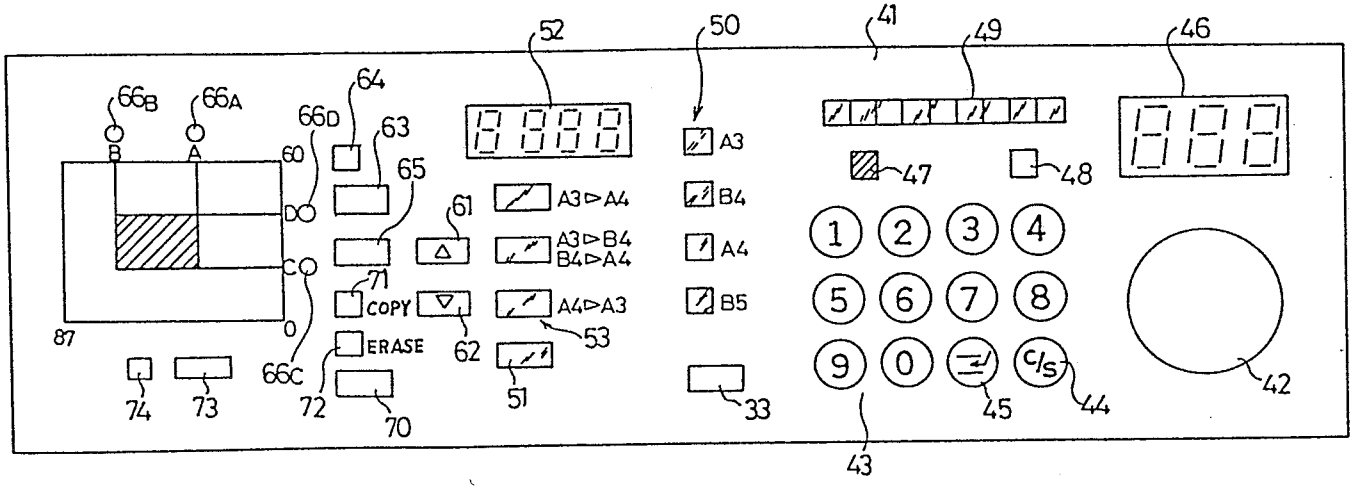
FIG. 3 is a plan view of an operation panel.

An operation panel 41 is provided on the front top portion of the main body 1. With reference to FIG. 3 showing the operation panel 41 in its entirety, the panel has a print key 42 for starting a copying operation. A temperature control wait mark, jam/trouble mark, toner absence mark, etc. can be shown as by liquid display means inside the print key 42. Disposed at one side of the print key 42 is a group of number entry keys 43 for setting the number of copies to be made. The key group includes a clear/stop key 44 for clearing the copy number or discontinuing the copying operation, and an interrupt key 45 for interruption copying.

A copy number display 46 provided above the print key 42 shows the number of copies entered by depressing number entry keys 43. The number on display is decremented by one every time one copying cycle is performed. On completion of the copying operation, the display is restored to the initial number setting. Arranged beside the display 46 are a copy density adjusting keys 47, 48 and a copy density display 49. The key 47, when depressed, gives an increased copy density, while the depression of the key 48 gives a decreased copy density.

A copy size change key 33 and a copy size display 50 are disposed beside the number entry keys 43. When the key 33 is depressed, the paper feeder currently in use is changed over to another paper feeder for use, and the size of copy paper ready for use is shown on the display 50.

Arranged beside the copy size change means are a magnification selection key 51, a magnification data display 52 and a specific magnification display 53 for showing specific magnifications in terms of the relation between the document size and the copy size.

An up key (up input means) 61 and a down key (down input means) 62 for input data are disposed beside the magnification selection means. Further arranged beside these keys 61, 62 are an edition mode key (edition mode specifying means) 63 and an edition mode display 64. The edition mode key 63, when depressed, sets the machine in the edition mode wherein the portion of the document image specified by coordinate settings is copied or erased, and turns on the edition mode display 64. The edition mode is cancelled when the edition mode key 63 is depressed again. While the machine is not in the edition mode, the depression of the up key 61 or the down key 62 increases or decreases the set magnification. When the key 61 or 62 is depressed in the edition mode, the initially set coordinate value is increased or decreased.

A coordinate selection key 65 for setting coordinates is provided below the edition mode key 63. Every time the key 65 is depressed while the edition mode display 64 is on in the edition mode, coordinate displays 66A, 66B, 66C, 66D provided adjacent to the keys 63 to 65 for the coordinates A, B, C, D are turned on one after another, so that the desired coordinate can be set as to the display which is on, using the up key 61 or the down key 62. When the coordinate setting is completed for the displays 66A to 66D, the coordinates of the four-side positions for edition are completely specified, whereby the edition area to be copied or erased is specified. The magnification data display 52 also serves to show the coordiante values thus set.

Arranged below the display means for showing the set coordinates A to D are a coordinate initial value change key 73 for changing the coordinate values to be set initially and a display 74 for the key 73. The key 73, when depressed, sets the machine in a coordinate initial value change mode, and the display 74 is turned on. When the key 73 is depressed again, the change mode is cancelled.

On initialization, the machine is adapted to be set to the coordinate values of A=0, B=87, C=0 and D=60 representing the maximum area that can be edited. However, it is desired that the maximum area be of the same size as the copy sheet to be used. In this case, the coordinate initial values to be set are adjusted according to the size of copy sheet to be used.

Arranged below the coordinate selection key 65 are a copying/erasure selection key 70 and displays 71, 72 for showing whether the set edition area is to be copied or erased.

Instead of showing the set coordinate values on the data display 52, the edition area may of course be shown specifically by turning on display means around the document support table or lamps at specified positions on a scale.

Figure 4:
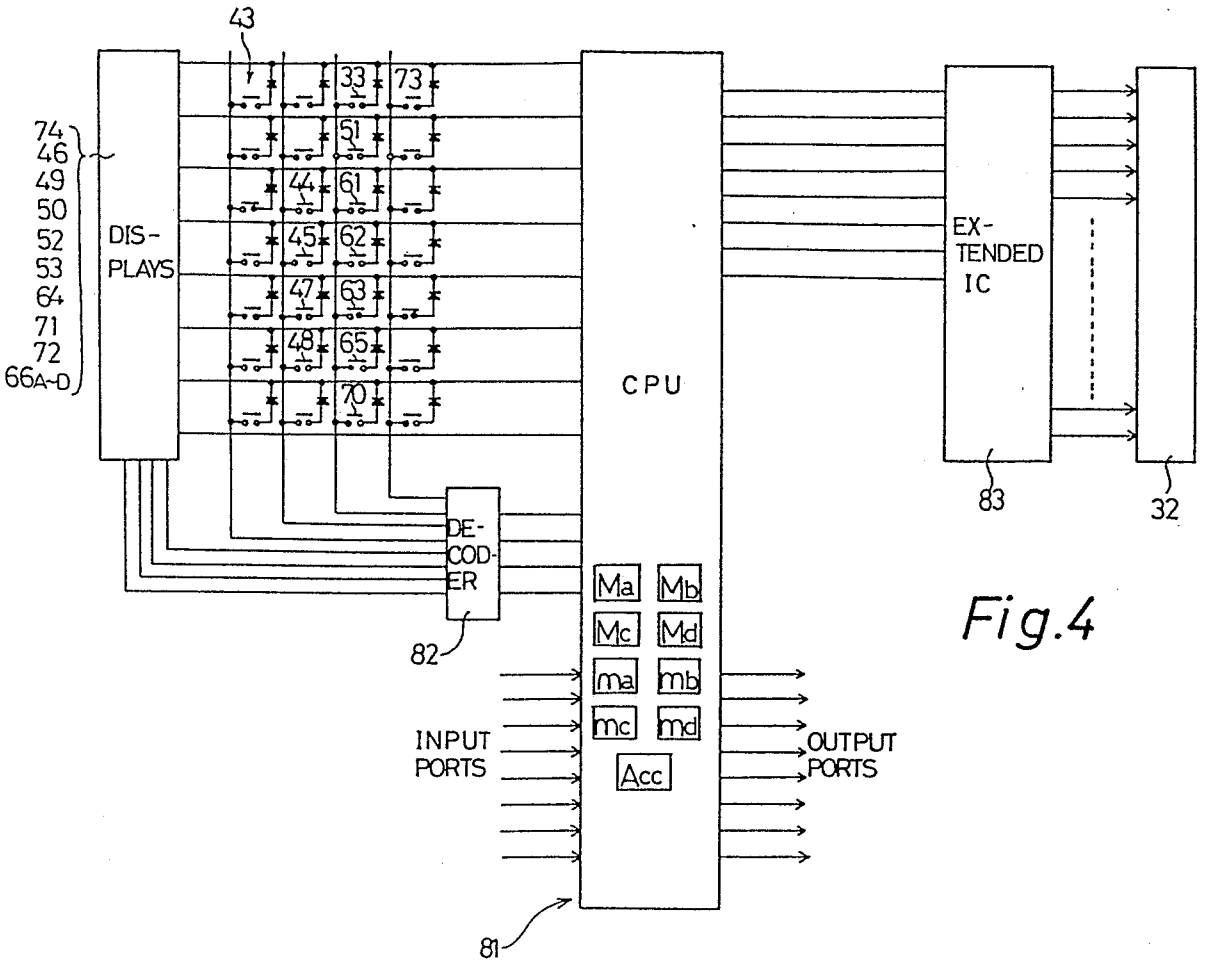
FIG. 4 is a block diagram of a control system.

The operation of various components in the main body 1 is controlled by a CP (control means) 81 shown in FIG. 4. The CPU is illustrated as connected to the foregoing keys, the displays related to the operation thereof and the eraser unit 32. The keys and displays are connected in the form of matrix to show data as read on time division basis using a decoder 82. The eraser unit 32 is driven by outputs delivered thereto from the CPU 81 via an extended IC 83.

The CPU 81 includes memories Ma, Mb, Mc and Md for storing the initial values of coordinates A, B, C and D to be set, respectively. Further included in the CPU 81 are memories for storing data relating to the coordinates and to be actually used for controlling the copying operation, i.e., a coordinate A memory ma, coordinate B memory mb, coordinate C memory mc and coordinate D memory md. Also provided in the CPU 81 are an accumulator Acc for temporarily storing data as to the coordinates, and other means.

Figure 5:
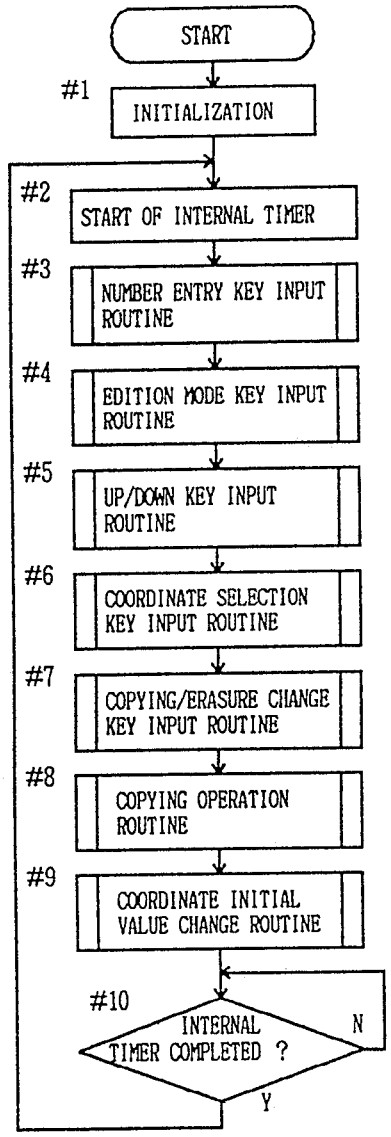
FIG. 5 -is a flow chart showing a control process main routine.

Next, the operation control process for the main body 1 to be executed by the CPU 81 will be described generally with reference to the flow chart of FIG. 5.

When the CPU 81 is reset to start the program, step #1 performs initialization. For example, the RAM is cleared and various registers are set to initialize the CPU 81, and the apparatus is set in the initial mode. In this initialization step, the coordinate initial value memories are set to the values of: Ma=0, Mb=87, Mc=0 and Md=60.

In the next step #2, the internal timer included n the CPU 81 and set to a predetermined value by initialization is started.

Step #2 is then followed by step #3 for a number entry key input subroutine, step #4 for an edition mode key input subroutine, step #5 for an up/down key input subroutine, step #6 for a coordinate selection key input subroutine, step #7 for a copying/erasure change key input subroutine, step #8 for a copying operation subroutine (inclusive of control of the erasure unit 32), and step #9 for a coordinate initial value change subroutine. On completion of these subroutines, the sequence proceeds to step #10, whereby one routine is completed on completion of the operation of the initially set internal timer operation. Using the time interval of one routine, various timers used in the subroutines perform a counting operation. (The completion of operation of these timers is judged from the number of routines counted.)

The subroutines will be described next except for the number entry key input subroutine and the copying operation subroutine which are known.

Figure 6:
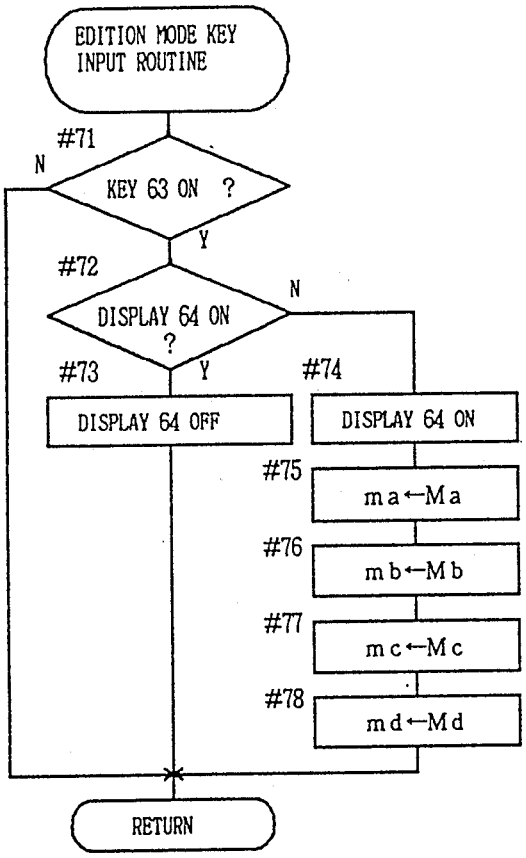
FIG. 6 is a flow chart showing an edition mode input subroutine.

The edition mode key input subroutine (step #4) is shown in FIG. 6.

Step #71 checks whether the edition mode key 63 has been depressed. When the depression of the key is detected, step #72 detects the current copying mode. When the current mode is found to be the edition mode with the edition mode display 64 turned on, the sequence proceeds to step #73, in which the copying mode is changed to the usual mode, and the display 64 is turned off.

On the other hand, if the copy mode is found to be the usual mode when the key 63 is depressed, the copying mode is changed to the edition mode and the display 64 is turned on in step #74. Further in steps #75 to #78, the values in the coordinate initial value memories Ma to Md are stored in the memories ma to md, respectively.

Figure 7:
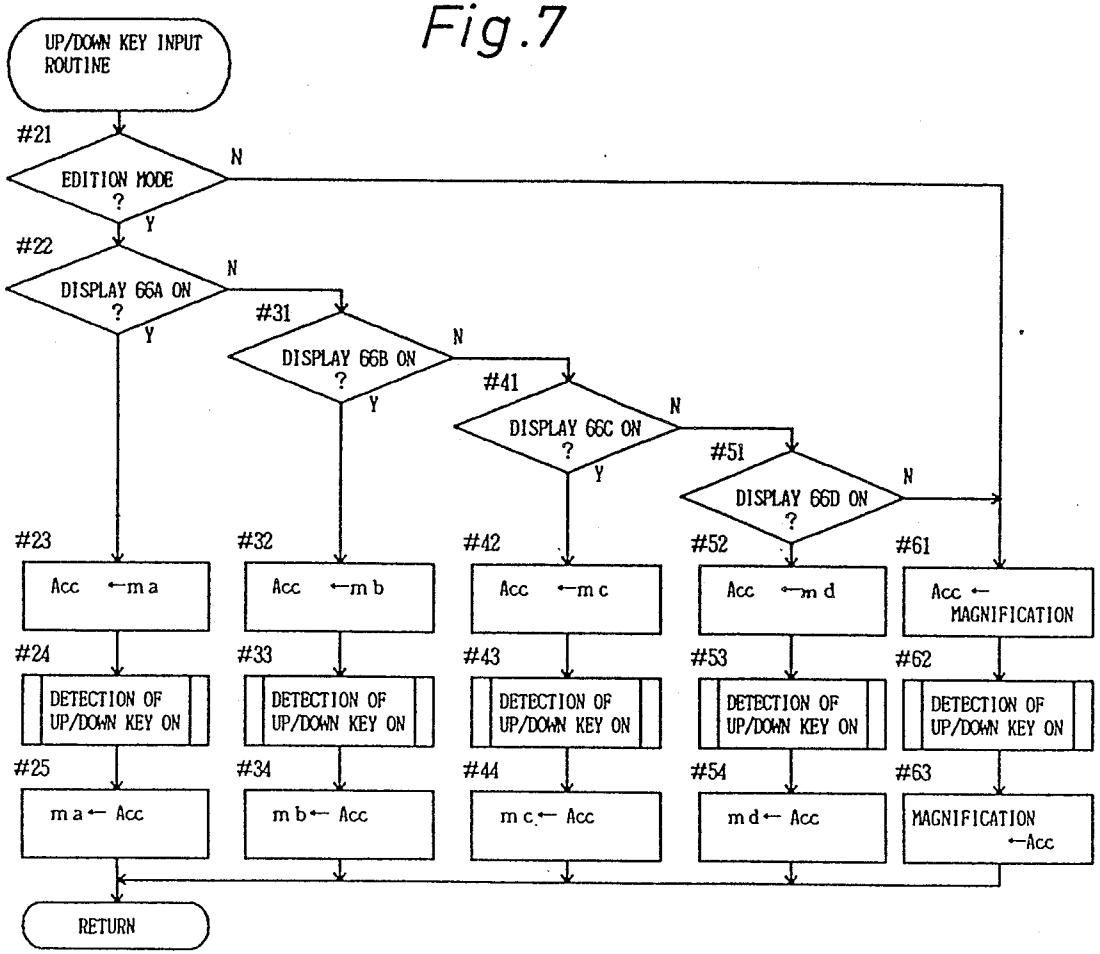
FIG. 7 is a flow chart showing an up/down key input subroutine.

FIG. 7 shows the up/down key input subroutine (step #5).

When the machine is in the edition mode, the sequence proceeds from step #21 to step #22. The initial values stored in the memories ma to md are increased or decreased by the up key 61 or the down key 62 to set coordinate data times, which are then stored in the memories ma to md again.

More specifically, when the coordinate A display 66A is on (YES to the inquiry of step #22), steps #23 to #25 follow, in which the data in the coordinate A memory ma is transferred to the accumulator Acc, the data is altered by the up key 61 or down key 62, and the altered data is stored in the memory ma again.

Similarly, when the coordiante B display 66B is on (YES to the inquiry of step #31), when the coordiante C display 66C is on (YES to step #41), and when the coordinate D display 66D is on (YES to step #51), steps #32 to #34, steps #42 to #44, and steps #52 to #54 are performed. Thus, the data in the memories mb, mc, md is transferred to the accumulator Acc, the data is changed by the up key 61 or down key 62 and the changed data is stored in the memories mb, mc, md again.

When the machine is found to be in the usual mode, the sequence proceeds to steps #61 to #63, in which the desired magnification is set up by the up key 61 or down key 62.

Figure 8:
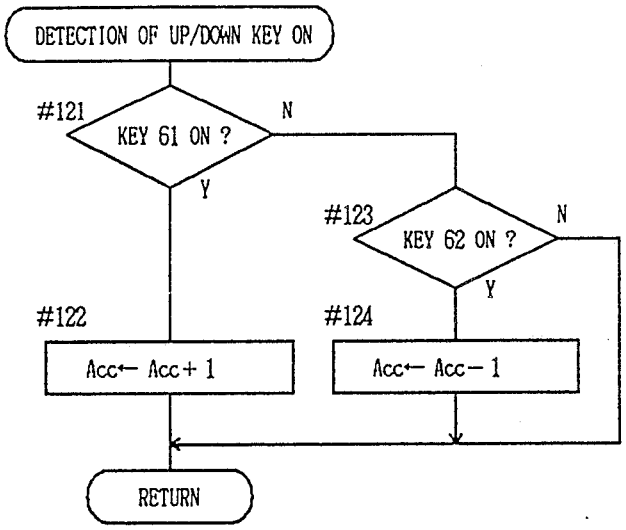
FIG. 8 is a flow chart showing up/down key on detection subroutine.

The procedure (step #24, #33, #43, #53 or #63) for changing the value in the accumulator Acc by the up key 61 or down key 62 is executed according to the up/down key on detection subroutine of FIG. 8. When the depression of the up key 61 or down key 62 is detected (step #121 or #123), the data in the accumulator is incremented or decremented by 1 accordingly (step #122 or #124).

The coordinate data is set by the up key 61 or down key 62 in the following manner. For the coordinates A and C, the initial set value 0 is altered by manipulating the up key 61. For the coordinates B and D, the initial set values 87 and 60, respectively, are altered by manipulating the down key 62. Thus, each edition coordinate can be set quickly merely by depressing the up or down key 61 or 62 to thereby alter the initial value to the desired value. Further when it is desired to slightly vary the coordinate value once set, the coordinate to be varied is selected by the selection key 65, and the up key 61 or down key 62 is then manipulated, hence a simple procedure.

Figure 9:
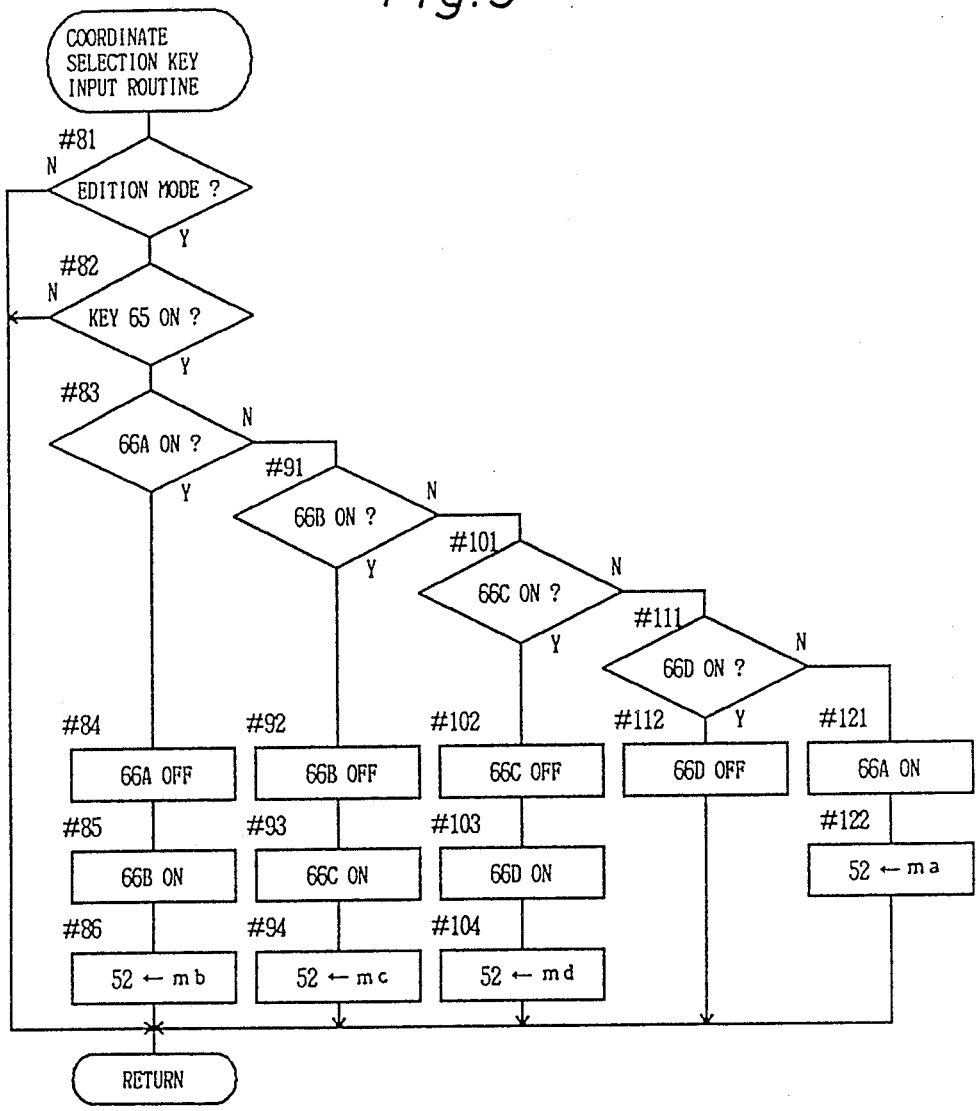
FIG. 9 is a flow chart showing a coordinate key input subroutine.

FIG. 9 shows the coordinate selection key input subroutine (step #6). When the copying mode is the edition mode (step #81), the CPU 81 detects an input from the selection key 65 (step #82), whereupon the coordinate data stored is shown on the data display 52 on the operation panel 41.

Stated more specifically, when none of the displays 66A to 66D for the coordinates A to D is on, the coordinate A display 66A is turned on (step #121), and the coordinate A data stored in the memory ma is displayed (step #122). When the display 66A is on (step #83), the display 66A is turned off (step #84), the coordinate B display 66B is turned on (step #85), and the coordinate B data in the memory mb is displayed (step #86).

Similar steps are performed also for the coordinate C data and the coordinate D data (steps #91 to #112).

Figure 10:
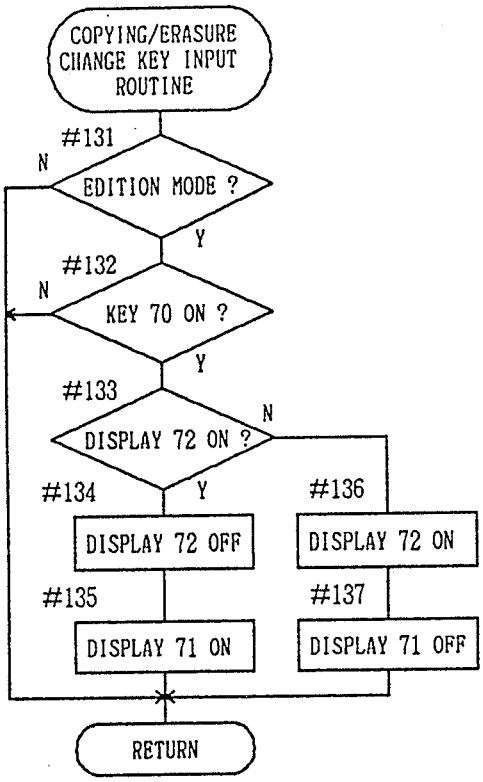
FIG. 10 is a flow chart showing a copying/erasure change key input subroutine.

FIG. 10 shows the copying/erasure change key input subroutine (step #7).

When the copying mode is the edition mode (step #131), the CPU 81 detects an input from the copying/erasure change key 70 (step #132), whereupon the current mode is checked as to whether it is an erasure mode wherein the edition set area is to be erased or a copying mode wherein the area is to be copied (step #133). If the erasure mode display 72 is on, indicating the erasure mode, the display 72 is turned off (step #134), and the copying mode display 71 is then turned on (step #135), thus changing the erasure mode to the copying mode.

On the other hand, if the erasure mode display 72 is found to be off in step #133, indicating the copying mode, the erasure mode display 72 is turned on (step

#136), and the copying mode display 71 is then turned off (step #137), thus changing the copying mode to the erasure mode.

Figure 11:
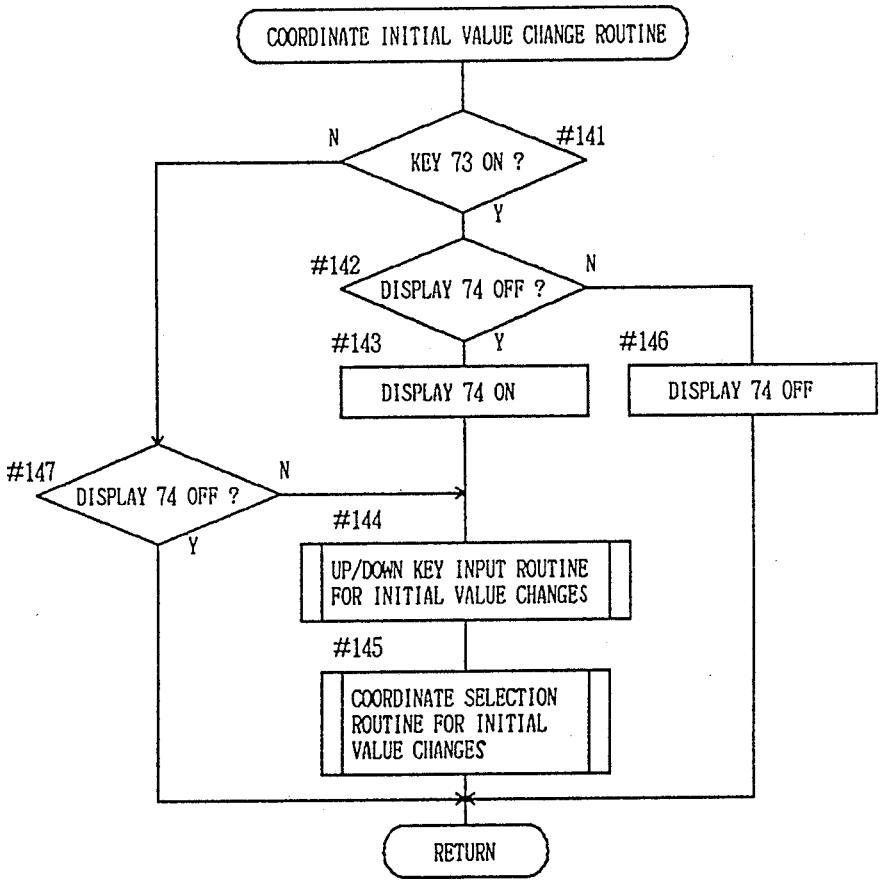
FIG. 11 is a flow chart showing an edition coordinate initial value change subroutine.

FIG. 11 shows the coordinate initial value change subroutine (step #9). When the CPU 81 detects an input from the coordinate initial value change key 73 in step #141, step #142 checks whether the display 74 is off to detect the current mode. Unless it is off, the mode is an initial value change mode. The sequence then proceeds to step #146 to turn off the display 74 to complete the subroutine. If the display 74 is off, indicating that the current mode is not the initial value change mode, the display 74 is turned on in step #143, followed by step #144 for an up/down key input routine for initial value changes and by step #145 for a coordinate selection routine for initial value changes.

If the depression of the change key 73 is not detected in step #141, the sequence proceeds to step #147 to detect whether the current mode is the change mode by checking whether the display 74 is off. When the change mode is detected, the initial value change steps #144 and #145 are performed. If otherwise, the routine is completed.

The up/down key input routine for initial value changes (step #144) and the coordinate selection routine for initial value changes (step #145) will be described next with reference to FIGS. 12 and 13.

Figure 12:
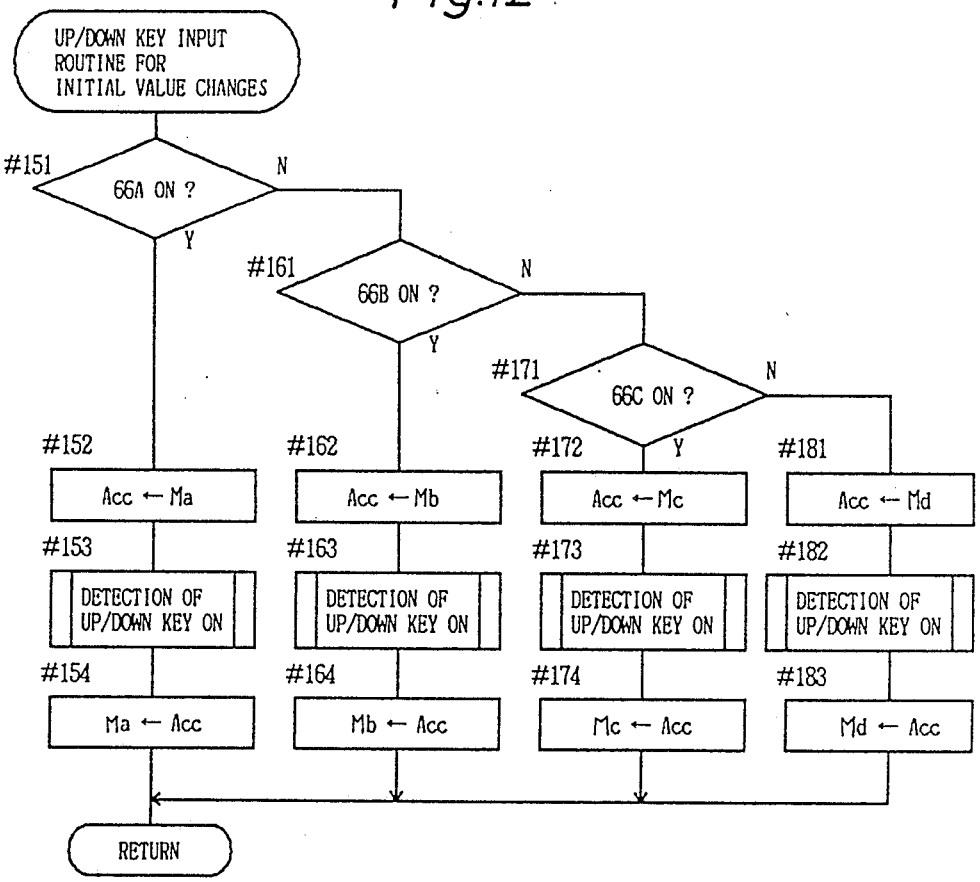
FIG. 12 is a flow chart showing an up/down key input subroutine for changing initial values.

When the coordinate A display 66A is found to be on in step #151 of the up/down key input routine of FIG. 12, the coordinate A initial set value stored in the memory Ma is transferred to the accumulator Acc and is then increased or decreased by the up key 61 or down key 62 in step #153. The resulting value is stored in the memory Ma again in step #154 as an initial set value as changed. Similarly, the coordinate B initial set value is changed when the coordinate B display 66B is on (steps #161 to #164), and the coordinate C initial set value is changed when the coordinate C display 66C is on (steps #171 to #174). Further when none of the displays 66A to 66C are on, the coordinate D display 66D is on, so that the coordinate D initial set value is then changed (steps #181 to #183).

Figure 13:
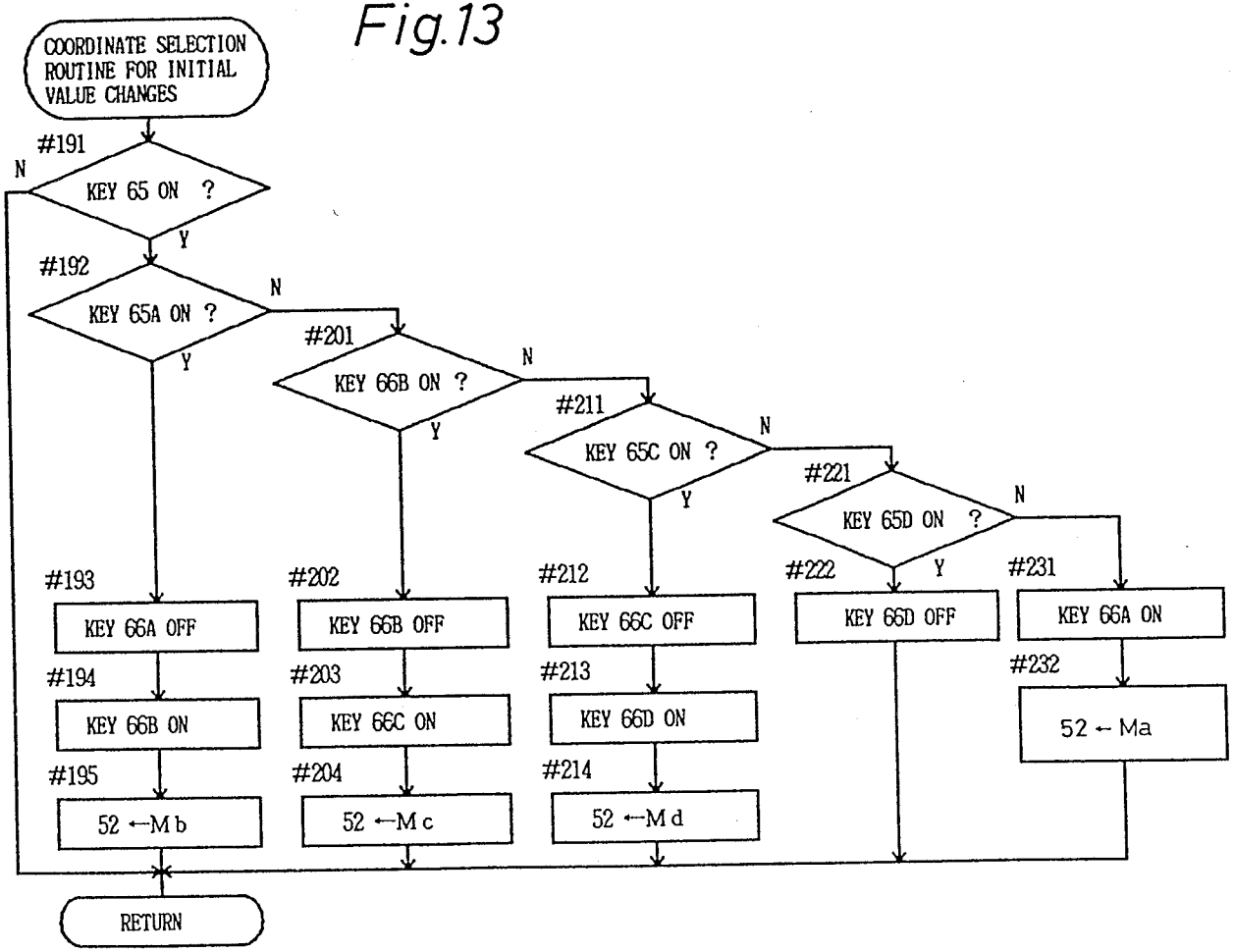
FIG. 13 is a flow chart showing coordinate selection subroutine for changing initial values.

With reference to FIG. 13 showing the coordinate selection routine, every time an input from the coordinate selection key 65 is detected in step #191, the coordinate initial value data stored in each of the memories Ma, Mb, Mc and Md is shown on the display 52. More specifically, when none of the displays 66A to 66D are on when the input from the key 65 is detected (steps #192, #201, #210, #221), the display 66A is turned on in step #231, and the value in the memory Ma is then shown on the display 52 in step #232.

When the display 66A is on, the sequence proceeds from step #192 to step #193 to turn off the display 66A. Subsequently, the display 66B is turned on in step #194, and the value in the memory Mb is shown on the display 52.

Similarly, the display 66B, if on, is turned off, the display 66C is turned on, and the value in the memory Mc is shown on the display 52 (steps #201 to #204). The display 66C, when on, is turned off, the display 66D is turned on, and the value in the memory Md is shown on the display 52 (steps #211 to #214).

When the display 66D is on, this indicates that the coordinate initial values have all been shown one after another on the display 52. The display 66D is therefore turned off to complete the routine (steps #221 to #222).

The electrophotographic copying machine described above has the coordinate initial value memories Ma, Mb, Mc, Md serving as means for storing the area data specifying a specific area of the document (edition set area data), and the coordinate memories ma, mb, mc, md serving as means for storing the area data for use in controlling the copying operation in the edition mode. When the edition mode is specified by the edition mode key 63, the data stored in the coordinate initial value memory means Ma to Md is transferred to the coordinate memory means ma to md and stored therein in response to the instruction.

As already stated with reference to the initialization step #1 of the main routine to be performed by the CPU 81, specific data is stored in the coordinate initial value memory means Ma to Md when the machine is to be initiated into operation (e.g. on turning on the main switch). Stored in the memory means according to the foregoing embodiment is the data specifying the maximum area which can be copied, i.e., A=0, B=87, C=0 and D=60. When the data stored in the memory means Ma to Md is not to be changed, the specific data is transferred to the coordinate memory means ma to md, respectively.

The data in the memory means ma to md is changed by the up key 61 or down key 62 (means for changing or altering the data), whereby the desired edition area can be set to form an image in the edition mode.

While the data set by the initialization of step #1 in the foregoing case is Ma=0, Mb=87, Mc=0 and Md=60, the values 43.5, 30, 43.5 and 30 may be stored in the coordinate initial value memory means Ma, Mb, Mc and Md, respectively. Thus, the specific data may be data specifying intermediate positions in the maximum area that can be copied. In this case, the coordinate data is set in the following manner by manipulating the up key 61 or down key 62. For the coordinate A and the coordinate B, the initial set value 43.5 is altered by depressing the up key 61 or down key 62, while for the coordinate C and the coordinate D, the initial set value 30 is altered by depressing the up key 61 or down key 62. Consequently, the desired coordinate values to be set can be obtained by varying the initial set values by up to ½ the size of the maximum area that can be copied. Thus, the coordinate setting can be accomplished easily and quickly merely by manipulating the up or down key 61 or 62 by small amounts. When it is desired to slightly vary the coordinate value once set, the coordinate to be varied is specified by the coordinate selection key 65, and the up key 61 or down key 62 is then depressed, hence a simple procedure.

With the electrophotographic copying machine described above, the data in the coordinate initial value memory means Ma to Md is changeable as desired by manipulating the change key 73, the up key 61 and down key 62. However, the memory means Ma to Md can be provided in the form of ROMs for storing fixed initial area data.

Further with the copying machine described, the data in each of the coordinate memory means ma to md is variable independently. However, for more reasonable or efficient coordinate setting, the up/down key input subroutine (step #5 in FIG. 5) in the edition mode may be modified as shown in FIG. 14.

Figure 14:
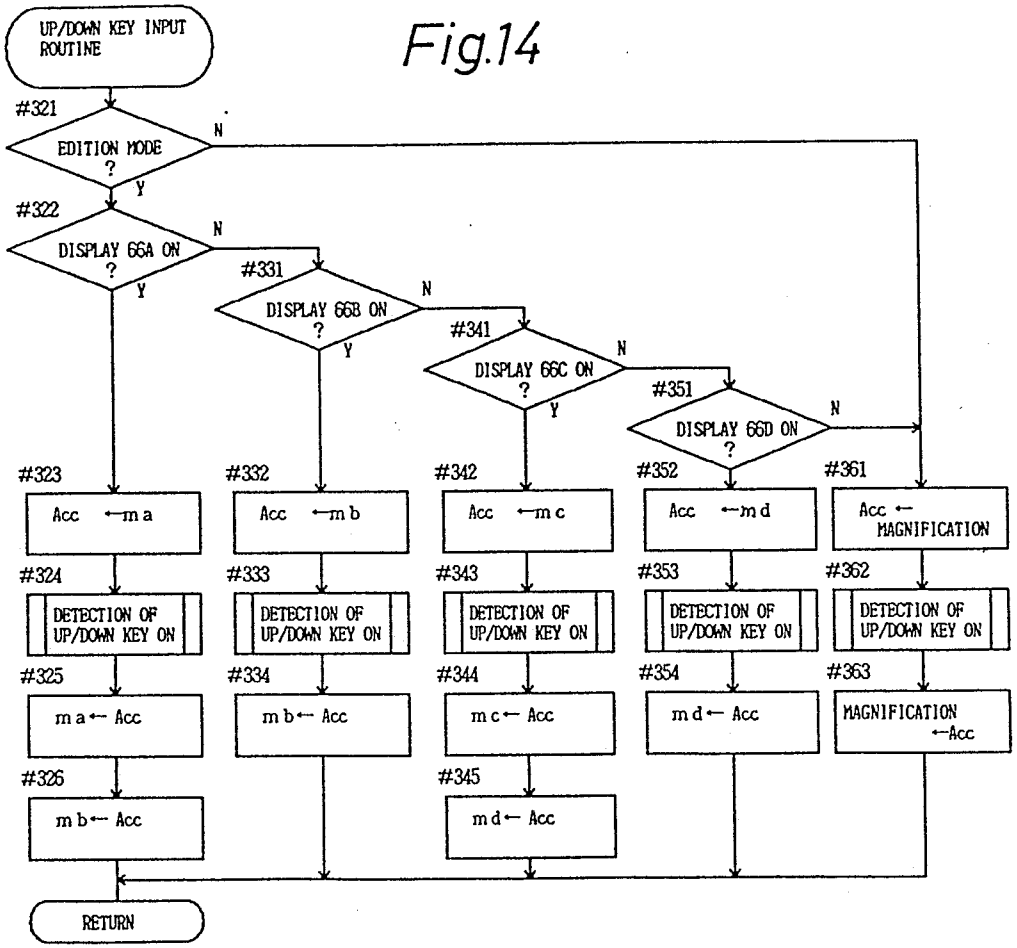
FIG. 14 is a flow chart showing another mode of up/down key input subroutine.

When the copying mode is the edition mode in the up/down key input subroutine of FIG. 14, the sequence proceeds from step #321 to step #322. The initial set values stored in the coordinate memories ma, mb, mc, md are increased or decreased by the up key 61 or down key 62, and the values thus set are stored in the respective memories ma to md again as coordinate data.

More specifically, when the coordinate A display 66A is on (YES to the inquiry of step #322), steps #323 to #325 are performed, in which the data in the coordinate A memory ma is transferred to the accumulator Acc, the value is changed by the up or down key 61 or 62, and the changed value is stored in the memory ma again. The value in the accumulator Acc is stored also in the coordinate memory mb in step #326. Thus, the same value is stored in the memories ma and mb.

When the coordinate B display 66B is on (step #331), the initial value stored in the memory mb simultaneously with the coordinate A setting is transferred to the accumulator Acc, the value is changed by the up key 61 or down key 62, and the changed value is stored in the memory mb again (steps #332 to #334).

When the coordinate C display 66C is on (YES to the inquiry of step #341), the same procedure as when the display 66A is on follows. In steps #342 to #345, the data in the coordinate C memory mc is transferred to the accumulator Acc, the value is changed by the up key 61 or down key 62, and the changed value is stored in the memories mc, md for the coordinates C and D.

When the coordinate D display 66D is on (YES to step #351), the same procedure as when the display 66B is on follows. In steps #352 to #354, the initial value stored in the coordinate D memory md as coordinate D data simultaneously with the coordinate C setting is transferred to the accumulator Acc, the value is changed by the up key 61 or down key 62, and the changed value is stored in the memory md again.

If the copying mode is found to be the usual mode in step #321, the desired magnification is set by the up or down key 61 or 62 in steps #361 to #363.

Consequently, the coordinate values A to D can be set easily and quickly merely by varying the respective initial values by the up key 61 or down key 62. Especially, the coordinates B and C can be set using the previously set coordinate A or C value in the same coordinate direction as the initial value, so that the coordinate B or C initial value is very likely to be set close to the desired value or can be very close thereto. The overall coordinate setting procedure can therefore be executed quickly.

In setting two coordinate values in the same coordinate direction, the coordinate value set first is used as the initial value for the other value to be thereafter set, such that the initial value is increased or decreased to the desired value of the second coordinate. The increase or decrease is the width of the edition area in the coordinate direction, permitting the operator to readily recognize the width thus set.

On the other hand, when it is desired to slightly alter the coordinate value once set, the coordinate to be altered is specified by the selection key 65, and the up key 61 or down key 62 is then manipulated to obtain the altered value, hence a simple procedure.

Although the coordinate A, as well as the coordinate C, is set first with respect to the coordinate direction concerned, the coordinates B and D may alternatively be set first.

Whichever of the coordinates A and B in the same coordinate direction may be set first, the set value is usable as the initial value for the coordinate value to be thereafter set. In this case, depending on which of the values A and B is set first, the up key 61 or the down key 62 is chiefly used for subsequently setting the other value. The coordinates C, D in the other coordinate direction are also set similarly.

With the electrophotographic copying machine adapted to perform the up/down key input subroutine of FIG. 14, the desired portion of a document can be specified by at least two coordinate data items as will be apparent from the relation between the coordinate A memory ma and the coordinate B memory mb. Specific data (for example, data as to A for specifying the maximum area which can be copied) is fed to the coordinate A memory ma serving as first coordinate memory means, and the data is altered by first changing means such as the up key 61 or down key 62. The altered data is stored in the first memory means ma again. At the same time, the data stored in the means ma can be stored in the coordinate memory mb serving as second coordinate memory means. For setting the coordinate B, the initial value therefor which is the same as the coordinate A set value can be altered by second changing means such as the up key 61 or down key 62. In other words, the data stored in the second coordinate means mb is altered, and the altered value can be stored in the second coordinate memory means mb again.

The document portion specified by the data stored as altered in the first memory means ma and the second memory means is copied on copy paper.

The first coordinate selection mode wherein the coordinate A is selected and the second coordinate selection mode wherein the coordinate B is selected are selected by mode selection means including the coordinate selection key 65.

The coordinate C memory means mc (first coordinate memory means) and the coordinate D memory means md (second coordinate memory means) have therebetween the same relation as between the memory means ma and the memory means mb.

As is apparent, many modifications and adaptations of the preferred embodiment can be made without departing from the scope and spirit of the invention. Therefore, it is to be understood that , within the scope of the appended claims, the invention may be practiced other than as specifically described therein.

What is claimed is:

1. A copying apparatus having a usual mode wherein a document image is copies in its entirety onto copy paper and an edition made wherein a desired portion of the document image is copied onto copy paper, the copying apparatus comprising:

image forming means capable of copying the document image in the usual mode and the edition mode, coordinate memory means for storing area data for use in controlling the copying operation of the apparatus in the edition mode, means for selecting the edition mode, means responsive to the selection of the edition mode for feeding specific area data to the coordinate memory means, means for varying the data stored in the coordinate memory means including a coordinate initial value memory for storing area data specifying a specific area of the document, and means for controlling the image forming means in the edition mode according to the data stored in the coordinate memory means.

2. An apparatus as defined in claim 1 wherein the area data to be stored in the coordinate memory means is numerical data.

3. An apparatus as defined in claim 2 wherein the data varying means comprises an up key, a down key, means responsive to the manipulation of the up key for increasing the numerical data stored in the coordinate memory means, and means responsive to the manipulation of the down key for decreasing the numerical data stored in the coordinate memory means.

4. An apparatus as defined in claim 1 further comprising means for varying the specific area data.

5. An apparatus as defined in claim 1 wherein the specific area data is data specifying the maximum area to be copied.

6. An apparatus as defined in claim 1 wherein the specific area data is data specifying intermediate positions in the maximum area to be copied.

7. A copying apparatus having a usual mode wherein a document image is copies in its entirety onto copy paper and an edition mode wherein a desired portion of the document image is copied onto copy paper, the copying apparatus comprising:

image forming means capable of copying the document image in the usual mode and the edition mode, coordinate initial value memory means for storing area data specifying a specific area of the document, coordinate memory means for storing area data specifying a specific area of the document for use in controlling the copying operation of the apparatus in the edition mode, means for selecting the edition mode, means responsive to the selection of the edition mode for transferring the data stored in the coordiante initial value memory means to the coordinate memory means and storing the data therein, key input means, and means responsive to the manipulation of the key input means for varying the data stored in the coordiante memory means.

8. An apparatus as defined in claim 7 wherein the area data is numerical data, and the coordinate initial value memory means and the coordinate memory means store numerical values.

9. An apparatus as defined in claim 8 wherein the key input means comprises an up key and a down key.

10. An apparatus as defined in claim 9 wherein the data varying means is responsive to the manipulation of the up key for increasing the numerical value stored in the coordinate memory means and responsive to the manipulation of the down key for decreasing the numerical value stored in the coordinate memory means.

11. An apparatus as defined in claim 10 wherein the coordinate initial value memory means stores an intermediate value in the range of numerical values variable by the up key and the down key.

12. An apparatus as defined in claim 10 further comprising means for varying the numerical value stored in the coordinate initial value memory means.

13. An apparatus as defined in claim 10 wherein the coordinate initial value memory means stores numerical values specifying the maximum area to be copied.

14. A copying apparatus adapted to specify a desired portion of a document by at least two coordinate data items and to copy the specified portion on copy paper, the apparatus comprising:

first coordinate memory means for storing first data included in the area data for use in controlling copying operation in an edition mode, second coordinate memory means for storing second data included in the area data for use in controlling the copying operation in the edition mode, means for feeding specific coordinate data to the first coordinate memory means, first varying means for varying the data stored in the first coordinate memory means and causing the first coordinate memory means to store the varied data again, means for causing the second coordinate memory means to store the data stored in the first coordinate memory means, second varying means for varying the data stored in the second coordinate memory means and causing the second coordinate memory means to store the varied data again, and means for copying on copy paper the document portion specified by the data stored in the first and second coordinate memory means.

15. A copying apparatus adapted to specify a desired portion of a document by at least two coordinate data items and to copy the specified portion on copy paper, the apparatus comprising:

first coordinate memory means for storing first data included in the area data for use in controlling copying operation in an edition mode, second coordinate memory means for storing second data included in the area data for use in controlling the copying operation in the edition mode, means for causing the first coordinate memory means to store specific coordinate data, data variation command input means, mode selection means for selecting one of a first coordinate selection mode and a second coordinate selection mode, first varying means responsive to a data variation command in the first coordinate selection mode for varying the data stored in the first coordinate memory means and causing the first coordinate memory means to store the varied data again, means for causing the second coordinate memory means to store the data stored in the first coordinate memory means when the second coordinate selection mode is selected, second varying means responsive to a data variation command in the second coordinate selection mode for varying the data stored in the second coordinate memory means and causing the second coordinate memory means to store the varied data again, and means for copying on copy paper the document portion specified by the data stored in the first and second coordinate memory means.

16. An apparatus as defined in claim 15 which further comprises an edition mode selection means for selecting one of an edition mode and a usual mode and wherein the copying means copies the document portion specified by the data stored in the first and second coordinate memory means on copy paper in the edition mode, or copies the document in its entirety on copy paper in the usual mode.

17. An apparatus as defined in claim 15 wherein the coordinate data is numerical data.

18. An apparatus as defined in claim 17 wherein the means for causing the first coordinate memory means to store specific coordinate data operates when an edition mode is selected by edition mode selection means.

19. An apparatus as defined in claim 17 wherein the data variation command input means comprises an up key and a down key.

20. An apparatus as defined in claim 19 wherein the first varying means is responsive to the manipulation of the up key in the first coordinate selection mode to increase the numerical value in the first coordinate memory means and cause the first coordinate memory means to store the increased value again.

21. An apparatus as defined in claim 19 wherein the first varying means is responsive to the manipulation of the down key in the first coordinate selection mode to decrease the numerical value in the first coordinate memory means and cause the first coordinate memory means to store the decreased value again.

22. An apparatus as defined in claim 19 wherein the second varying means is responsive to the manipulation of the up key in the second coordinate selection mode to increase the numerical value in the second coordinate memory means and cause the second coordinate memory means to store the increased value again.

23. An apparatus as defined in claim 19 wherein the second varying means is responsive to the manipulation of the down key in the second coordinate selection mode to decrease the numerical value in the second coordinate memory means and cause the second coordinate memory means to store the decreased value again.

* * * * *